US007311622B1

(12) United States Patent
Futtere

(10) Patent No.: US 7,311,622 B1
(45) Date of Patent: Dec. 25, 2007

(54) WIRE BROADHEAD APPARATUS AND METHOD

(76) Inventor: Matthew Futtere, P.O. Box 806, Liberty Hill, TX (US) 78642

( * ) Notice: Subject to any disclaimer, the term of this patent is extended or adjusted under 35 U.S.C. 154(b) by 0 days.

(21) Appl. No.: 11/280,921

(22) Filed: Nov. 16, 2005

Related U.S. Application Data

(60) Provisional application No. 60/646,238, filed on Jan. 21, 2005, provisional application No. 60/628,263, filed on Nov. 16, 2004.

(51) Int. Cl.
*F42B 6/08* (2006.01)

(52) U.S. Cl. ..... 473/583

(58) Field of Classification Search ..... 473/582, 473/583, 584
See application file for complete search history.

(56) References Cited

U.S. PATENT DOCUMENTS

| | | | | | |
|---|---|---|---|---|---|
| 2,671,664 | A | * | 3/1954 | Zwickey | 473/582 |
| 2,725,656 | A | * | 12/1955 | Schmidt | 43/6 |
| 2,937,873 | A | * | 5/1960 | Grissinger | 473/582 |
| 2,939,708 | A | * | 6/1960 | Scheib | 473/582 |
| 3,014,305 | A | * | 12/1961 | Yurchich | 43/6 |
| 3,604,708 | A | * | 9/1971 | Brozina | 473/584 |

* cited by examiner

*Primary Examiner*—John A. Ricci
(74) *Attorney, Agent, or Firm*—J. Nevin Shaffer, Jr.

(57) ABSTRACT

A wire broadhead apparatus according to an embodiment of the invention includes a support structure. A flexible wire with a first end and a second end is provided. The wire is connected to the support structure between the ends and both ends make sliding engagement with the support structure.

8 Claims, 4 Drawing Sheets

WIRE BROADHEAD APPARATUS AND METHOD

CROSS REFERENCE TO RELATED PROVISIONAL APPLICATIONS

This application claims the benefit of previously filed U.S. provisional patent applications No. 60/628,263 filed Nov. 16, 2004 for a "Flexible Extended Wire Broadhead Apparatus and Method" and No. 60/646,238 filed Jan. 21, 2005 for a "Guided Wire Flexible Shaped Wire Broadhead Apparatus and Method". The Applicant hereby claims the benefit of these provisional applications under 35U.S.C. §119. The entire content of these provisional applications are incorporated herein by this reference.

TECHNICAL FIELD

This invention relates to a wire broadhead apparatus. In particular, according to one embodiment, this invention relates to a wire broadhead apparatus including a support structure. A wire, with a first end and a second end, is moveably attached to the support structure such that the first end and the second end are free to move along the support structure. The flexible wire extends outwardly from the support structure and the first and second ends moveably engage the support structure according to one embodiment. Further, the wire is flexible and, according to one embodiment, it includes at least one sharp edge.

BACKGROUND OF THE INVENTION

Humane hunting requires a system for killing prey quickly. Problems exist with current hunting devices, bows and arrows and projectiles such as bullets in that, in particular, the killing area of the arrow or projectile is difficult to expand without introducing detrimental side effects.

A "broadhead" is the sharpened implement mounted on the end of the shaft of an arrow that provides the penetrating and cutting mechanism of, typically, the chest cavity region of the targeted big game animal which results in the ethical and humane killing of the hunted animal. While broadheads are useful hunting tools, they would be even more useful if they could be accurately delivered to the desired area of the animal. Unfortunately, the evolution of the broadhead has provided no significant changes in design or shape other than those advantages and efficiencies derived from newer materials and better machining techniques for fixed blade broadheads. They remain rigid for "fixed bladed broadheads" and mechanically complex for "mechanical broadheads" which after deploying blades at impact then also remain rigid. With the advent and availability of improved materials, the bow for delivering the arrow has also improved considerably. Compound bows are much more efficient than traditional equipment and result in the capability to launch arrows at considerably higher velocities. Unfortunately, these higher velocities introduce significant aerodynamic problems in maintaining accurate arrow flight with a broadhead attached. This unwanted resultant inaccurate arrow flight has been termed "steering effect". Prior art attempts to minimize this steering effect have taken two directions Currently, one solution is to stay with the traditional two, three, four or more razor blades rigidly affixed to the ferrule or shaft. Here, attempts to minimize the steering effect on larger diameter cutting width broad heads have focused on reducing the surface area of fixed blades in two manners.

First, the prior art blade's overall cutting width has been reduced to maintain as narrow an aerodynamic profile as possible. In this case the blades are swept back from the tip like wings on a fighter aircraft. Additionally, cut outs within the blade were implemented. Currently, minimum cutting widths of no less than seven-eights of an inch are permitted. Generally acceptable flight is achieved at these widths. However, the steering effect is exacerbated with increasing arrow velocities achieved with today's modern bows. Even a narrow blade width can cause trouble in achieving repeatable accurate arrow flights due to pressure exerted by the air, up drafts, down drafts or wind, as the arrow flies to its intended target.

A second prior art "solution" to eliminate the steering effect problem has been to create a mechanical broadhead that has its blades closed during flight. Upon contacting the intended target, these broadheads include some form of mechanism that causes the blades to pop open on impact thus exposing lethal cutting surfaces. With no flat surfaced blades exposed during flight, the steering effect is minimized since there are no pressure differences generated on exposed blade surfaces. Several disadvantages of these so-called "mechanical" broadheads exist such as, for example only, reduced penetration of the broadhead, structural weakness of the various broadhead elements, and inoperability at the critical moment of contact with the game animal. Additionally, much more kinetic energy is required to achieve equal penetration compared to fixed broadhead blades. Further, while the edges of the flat blade are sharp, the backside of the flat broadhead blades known in the art are dull and inhibit easy removal as the dull object is pulled out of the target/animal. That is, no consideration in design in the prior art has been given to providing lethal cutting efficiency when the projectile is moved in a reverse direction from that of its entry path.

In short, maintaining strength upon impact, having large cutting widths, achieving good penetration and maintaining accurate arrow flight are the desired characteristics of a hunting arrow tipped with a broadhead and/or any projectile used instead. Maintaining mechanical simplicity, narrow profile in flight and maximum cutting surface length while transiting the target animal and while maximizing efficient use of the magnitude of the stored kinetic energy within the broadhead tipped arrow shaft to humanely kill the targeted game animal are also desirable.

It is appropriate to note that Applicant has created a superior broadhead blade and air flow equalizer apparatus and method as set forth in his co-pending non-provisional application Ser. No. 10/745,389 and his two provisional application Nos. 60/628,263 and 60/646,238 each of which is incorporated herein by reference. In particular application Ser. No. 10/745,389 is a broadhead designed for use in hunting of big game birds and is not generally applicable for use in hunting big game animals. As a result, problems still exist in the art as set forth above for pursuing big game animals. As such there is a need in the art for an apparatus and method for use with structures such as arrows, projectiles and such that increases the area of impact without decreasing the important aspects of accuracy and maximum impact to the target. That is, there is a need for an broadhead arrow, for example only, with a wide impact area that maintains target tip like accuracy at any arrow velocity, that incorporates flexibility in transiting bone structures such as a rib cage in a game animal in a manner that significantly minimizes the amount of kinetic energy lost to penetration, that reduces lateral drag on the arrow shaft, that provides broad, lethal cutting surface exposure at all times. That is flexible to ensure compressed width cutting surface during hard bone structure penetration with minimal kinetic energy loss, yet which flexes back to maximum cutting width of soft tissue vital organs once the cutting surfaces transit past the harder chest cavity surfaces such as rib cage bones both during entry and exit of the chest cavity and that minimizes cutting width to again exit the ribbed chest cavity. Further, a need exists for an easy to attach and failure resistant broadhead that maximizes mechanical simplicity of design.

SUMMARY OF THE INVENTION

Accordingly, the guided flexible shaped wire broadhead of the present invention includes, according to one embodiment, a support structure. A flexible shaped wire with a first end and a second end is moveably attached between the first and second ends to the support structure. The first and second ends are formed in closely spaced apart relation to each other and the wire is shaped so as to return to the closely spaced apart relation when moved. The ends are not attached to the support structure but moveably engage grooves in the support structure within which the ends are free to move. The stored energy of the memory set wire provides mechanical pressure to keep the shaped flexible wire ends snapped onto the broadhead and ends within the "slides" or grooves. These aspects of engineering in flexibility and use of stored energy as in this case the spring like quality due to the memory set shape are the first ever utilized within the history of broadhead or projectile design and protection should not be limited to this particular mechanical specific design/shape.

According to another aspect of the invention, the support structure includes stop controls. According to a further aspect, the stop controls are a pair of radius bend points. According to a further aspect, more than one guided flexible shaped wire is connected to the support structure. According to a further aspect the support structure includes a through hole. According to another aspect, a pair of off set through holes are provided in said support structure.

According to another aspect, the guide flexible shaped wire has at least one sharpened edge.

According to any embodiment, the wire or wires of the present invention provide a minimal cross sectional surface area during flight from, for example only, bow to target animal. Thus the introduction of unwanted lift, as discussed above with regard to prior art broadhead designs, is negated or greatly minimized. Hence target tip accuracy with a broadhead is obtained. Further, upon striking the intended animal, the narrow in flight profile allows immediate cutting by the wire or wires upon penetration to the contact point of the wire and does not rely on any mechanical movement of a blade to induce cutting action such as all prior art mechanical broadheads. This is true even at more extreme angled shots in relation to the position of the targeted animal. Upon penetrating the distance to the ends of the wire, or wires, past the immovable structure of the bones of the rib cage, for example, expansion of the flexible extended wire, preferably memory shaped and spring like in nature, extends the wire to its full original diameter and allows maximum cutting width of the soft tissue vital organs to take place both upon entry and, uniquely, upon removal. Further, according to the present invention, because the closely spaced apart ends are free to move within the grooves in the base of the body, pressure on the wire is relieved during compression loads and breakage of the wire is prevented.

According to another embodiment in a broadhead arrow with at least one or more cutting surfaces, the cutting surface or surfaces are made of razor sharpened flexible wire/memory shaped wire material or similar razor sharp wire like material.

According to another embodiment in a broadhead arrow with at least one or more cutting surfaces, a razor sharpened memory shaped wire is mounted via a thru hole or holes that is/are perpendicular to the direction of travel of the projectile/arrow.

BRIEF DESCRIPTION OF THE DRAWINGS

Other objects, features and advantages of the present invention will become more fully apparent from the following detailed description of the preferred embodiment and the accompanying drawings in which.

DETAILED DESCRIPTION OF THE INVENTION

Figure 1:
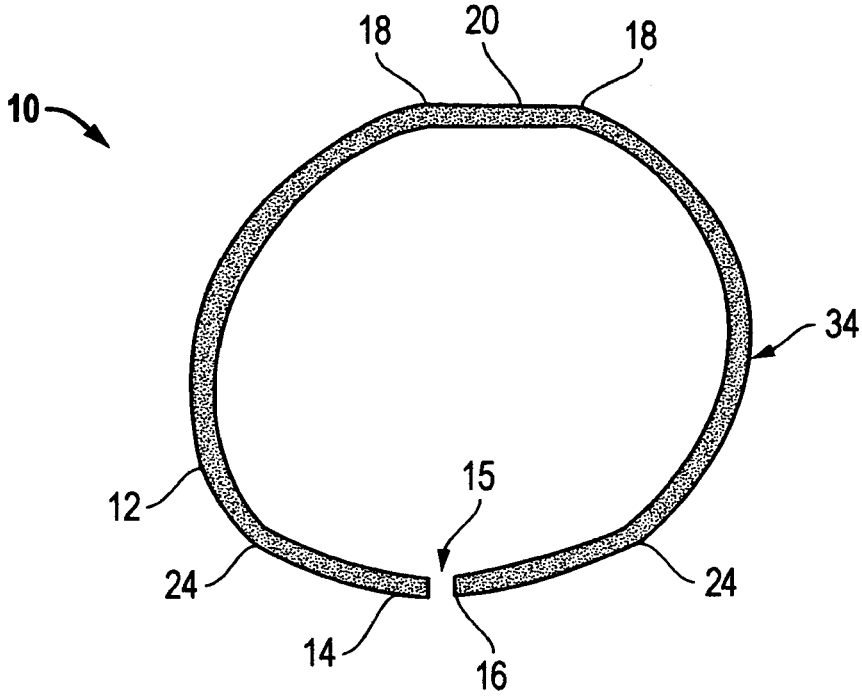
FIG. 1 is a side view of the wire broadhead apparatus according to one embodiment of the invention showing the first and second ends in closely spaced apart relation.

An embodiment of the present invention is illustrated by way of example in FIGS. 1-12. With specific reference to FIGS. 1 and 2, the wire broadhead apparatus 10 according to one embodiment of the present invention includes wire 12. Wire 12 is shaped as indicated and includes two ends, end 14 and end 16. The figures also illustrate that ends 14 and 16 are formed so as to be closely spaced apart. The space 15 is of no particular dimension so long as the ends are close and not connected to each other. Further, wire 12 is generally circular in shape and this shape is maintained in the wire's "memory" so that wire 12 returns to this "original" shape after being stressed. Creating spring like wire forms that have memory so as to return to the desired original shape is well within the skill of those in the art and is not disclosed and discussed further herein.

Still referring to FIG. 1, wire 12 also includes, according to one aspect of the invention, stop controls 18. Stop controls 18 according to one embodiment, is an essentially straight section 20 followed by a radius bend at stop controls 18. As will be more fully described hereafter with relation to FIGS. 3 and 4, stop controls 18 cooperate with support structure 22 (see FIGS. 3 and 4) so as to connect wire 12 to support structure 22 by themselves with no other connection mechanism needed or desired.

FIG. 1 also illustrates another aspect of the invention wherein end bends 24 are added to wire 12 so that the ends 14 and 16 maintain contact with support structure 22 as more fully described hereafter. According to one embodiment, end bends 24 are bent inward toward straight section 20 and form an angle in wire 12 of more than ninety degrees as can be seen from FIGS. 1 and 2.

Figure 2:
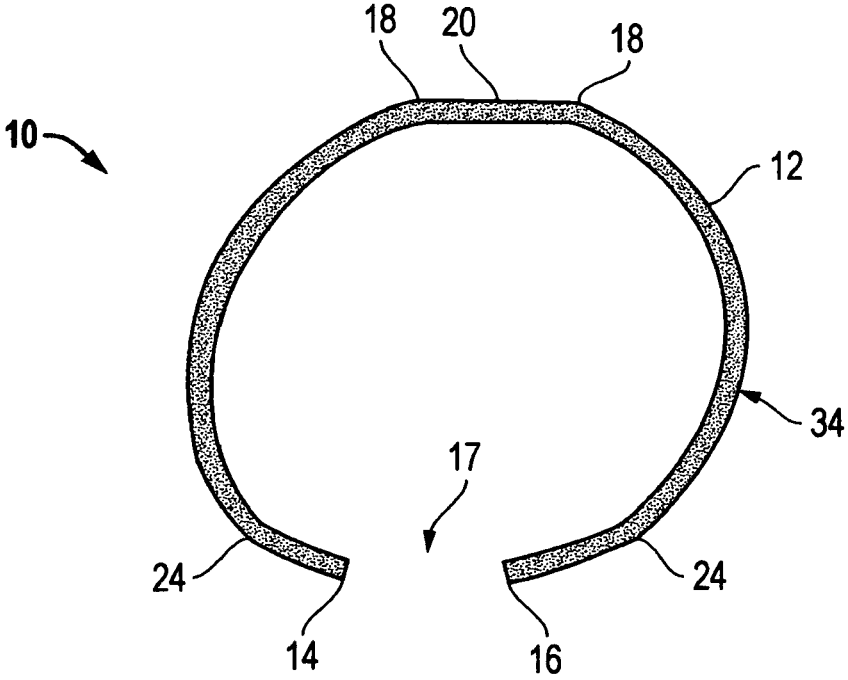
FIG. 2 is a side view of the apparatus of FIG. 1 illustrating the first and second ends moved further apart.

Referring to FIG. 2, end 14 and end 16 are shown in a spread apart position with a large space 17 when compared to the closely spaced apart position shown in FIG. 1 with a small separation space 15. Remembering that wire 12 is memory shaped in the position illustrated in FIG. 1, spreading ends 14 and 16 apart creates tension in wire 12 to return to its original position and original small separation space 15. As will be discussed more fully hereafter, according to the present invention, ends 14 and 16 are free to move. That is to say, ends 14 and 16 are not kept in a locked fixed position with relation to support structure 22 but are free to move along support structure 22 as discussed more fully hereafter. Thus, when pressure is applied to wire 12, wire 12 is protected from breaking because the ends 14 and 16 move and whatever pressure is applied is compensated for. Once the pressure is released, however, the shaped wire 12 is free to return to its original shape.

Figure 3:
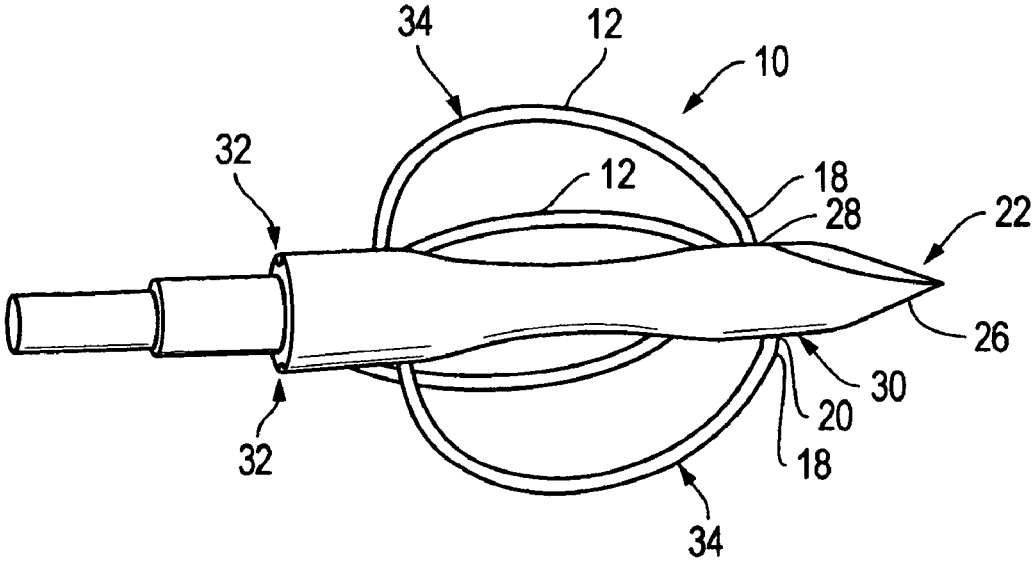
FIG. 3 is a side perspective view of the apparatus of the invention according to the embodiment set forth in FIG. 1 illustrating the guided flexible shaped wire moveably connected to a support structure.
Figure 12A:
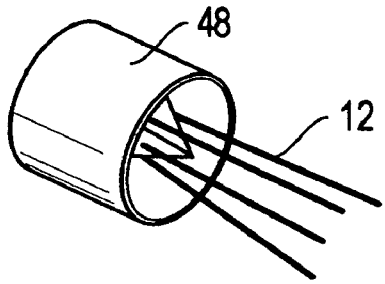
FIGS. 12 A-C illustrate another embodiment of the invention wherein the wire apparatus is enclosed within a sabot (FIG. 12 A), the wire apparatus leaves the sabot (FIG. 12 B) and the wire apparatus is in transit to a target with the wire in the cutting position (FIG. 12 C).
Figure 12B:
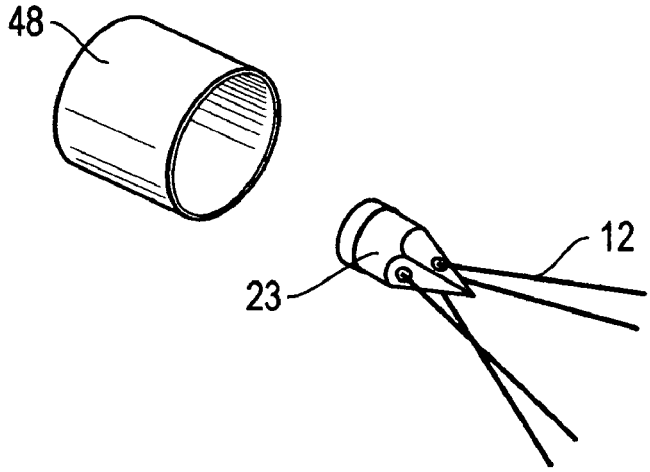
Figure 12C:
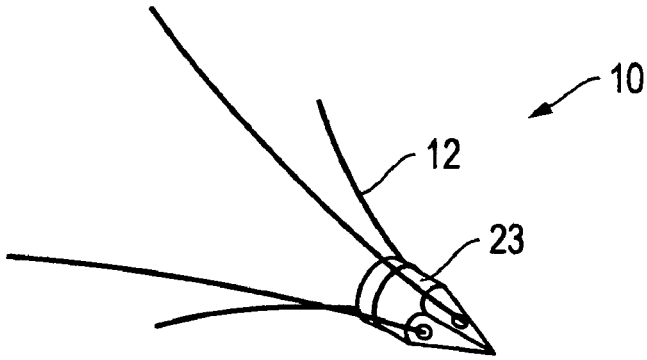

Referring now to FIG. 3, guided flexible shaped wire 12 is shown connected to support structure 22. By way of example only and not by limitation, support structure 22 is illustrated as an arrow head 26. Support structure 22 may be any other suitable structure now known or hereafter developed including for example only and not by way of limitation, a projectile 23 as shown in FIG. 12. FIG. 3, shows arrow head 26 with a pair of through holes 28 and 30. Through holes 28 and 30 are offset from one another as illustrated one above the other on arrow head 26. Through holes 28 and 30 pass approximately perpendicular to the length of arrow head 26 also as shown. According to this aspect of the invention, more than one wire 12 is connected to support structure 22. As shown in FIG. 3, two wires 12 are connected to arrow head 26. The connection of wires 12 to arrow head 26 is by means of stop controls 18 and straight section 20. All that is required to connect wire 12 to support structure 22, according to this aspect of the invention, is to pass one end 14 or 16 of wire 12 through hole 28 (or 30) and rotate the wire 12 until straight section 20 is located in through hole 28 (or 30). Thereafter, stop controls 18 prevent the wire 12 from rotating further.

FIG. 3 also shows grooves 32 in support structure 22. Grooves 32 have a length and a depth sufficient to capture ends 14 and 16 of wire 12. End bends 24 ensure that ends 14 and 16 are directed into grooves 32. Once ends 14 and 16 are located within grooves 32, the ends 14 and 16 are free to slide within the grooves but are prevented from moving out of the grooves 32 by the combination of the length and depth of the grooves 32 and the pressure of the wire 12 itself. That is, the simple process of fitting wire 12 to support structure 22 causes the closely spaced ends 14 and 16 to be spread apart by the width of the support structure 22. Since the wire 12 is shaped to the position illustrated in FIG. 1 wherein the space 15 is small, wire 12 causes pressure to be directed to ends 14 and 16 in an attempt to return ends 14 and 16 to the closely spaced apart space 15 position shown in FIG. 1. This pressure keeps ends 14 and 16 located within grooves 32 so that no other connection is needed or necessary and lateral movement of the wire 12 is prevented. In summary, FIG. 3 shows wire 12 in its "resting" position after attachment to support structure 22. Again, even though it is in the "resting" position the ends 14 and 16 are spaced farther apart than the designed small space 15 and are therefore tensioned toward each other within grooves 32.

Figure 4:
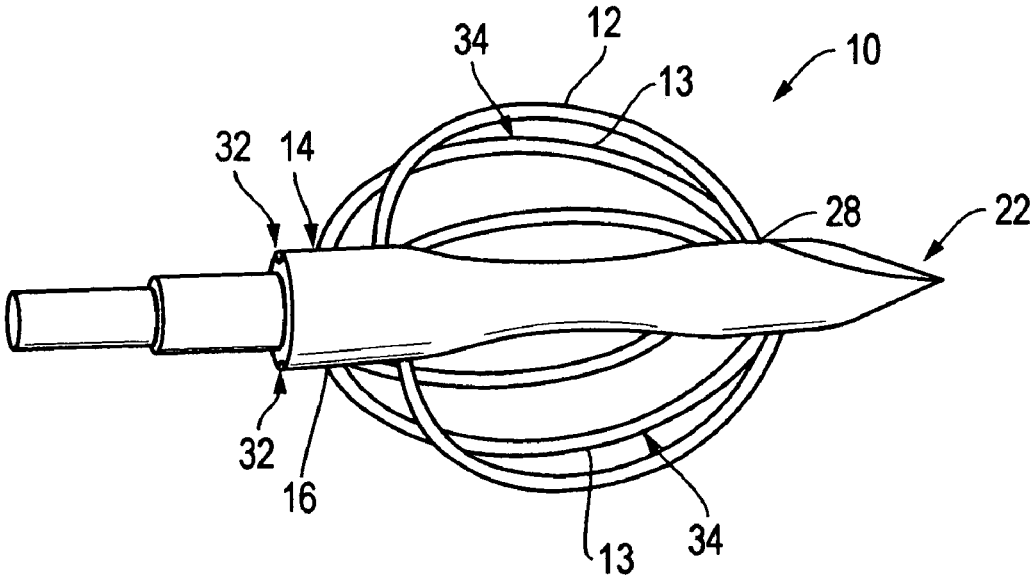
FIG. 4 is a side perspective view illustrating the ability of the guided flexible shaped wire to move within the grooves of the support structure.

Referring now to FIG. 4, the use of the grooves 32 in combination with the shaped wire 12 is illustrated. Upon impact, the flexible wire 12 is allowed to compress into a smaller diameter indicated as wire 13. This compression is accomplished by ends 14 and 16 sliding within grooves 32 in a direction away from straight section 20. Obviously, in an actual situation both wire 12 and wire 13 are compressed. Only one set is used here to illustrate the before stress location of the wire 12 in the fullest diameter and the during stress location of the wire 13. An important function of the free ends 14 and 16 is to allow movement and thereby prevent failure or breaking of wire 12 (and 13) under compression. Again, because of end bends 24 and the memory of wire 12 in its original shape with closely spaced apart ends 14 and 16, the ends 14 and 16 are held in close relation to support structure 22 during use.

As used herein, the term "support structure" includes any structure to which flexible wire(s) 12 are attached. The illustration in FIGS. 3 and 4 show support structure 22 in the form of an arrow with a tip. Nonetheless, it should be appreciated that other support structures are encompassed within the scope of the present invention including, but not limited to, for example only, bullets and/or projectiles 23 for use with guns as will be discussed more fully with regard to FIG. 12.

Figure 5:
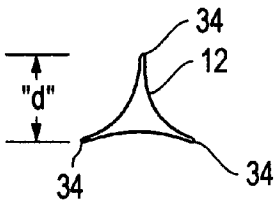
FIG. 5 is a cross sectional view of the wire of the invention according to one embodiment.

Referring now to FIG. 5, the profile shape of flexible wire 12 according to one embodiment is illustrated. According to this embodiment, flexible wire 12 includes razor-sharp edges 34. Normally, of course, wire is in the shape of a cylinder. The diameter "d" of the wire is any suitable diameter such as approximately 0.05 inches. According to the preferred embodiments of the invention, flexible wire 12 includes at least one razor sharp edge 34. More preferably, flexible wire 12 includes two sharp edges 34. Of course, flexible wire 12 may include three or more sharp edges 34 as desired.

Figure 6:
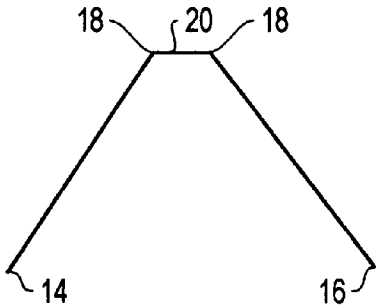
FIG. 6 is a side view of the wire broadhead apparatus according to another embodiment of the invention.

Referring now to FIG. 6, lengths of wire 12 may be any length desired. For example, each length of wire 12 may be approximately three inches long. Again, according to the invention, flexible wire 12 is a razor-sharp memory shaped wire. Such wires are well-known in the art and no further discussion is deemed necessary. Nonetheless, any wire capable of being formed so as to retain the required shape, separation and flexibility after repeated bending is suitable for the purposes of this invention. Whatever lengths of wire are desired and whatever separation of wire is desired is formed into flexible wire 12. As is illustrated in FIG. 1, the separation may be a small space 15 between ends 14 and 16. According to another embodiment, however, as is illustrated in FIG. 6, wire 12 may be formed in other memory retained shapes. In FIG. 6, wire 12 includes straight section 20 and stop controls 18 as with the other shape shown in FIG. 14. In this embodiment however, the lengths of wire 12 from stop control 18 to end 14 and from the other stop control 18 to end 16 are straight and not curved. In this embodiment, the ends 14 and 16 are very widely spaced apart as much as three inches. Further, as discussed more fully with regard to FIGS. 10 and 11, wire 12 is free to rotate around support structure 22 and the ends 14 and 16 are not movingly engaged with the support structure 22. However, just as discussed above with regard to FIG. 14, flexible wire 12 is attached to support structure 22 in the same manner. It should be noted that whatever shape it is in, flexible wire 12 clearly presents a very minimal aerodynamic surface and thus does not interfere with the flight of support structure 22, whatever that support structure may be.

Figure 7:
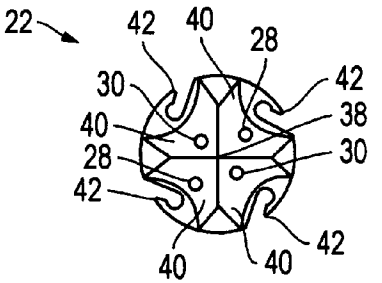
FIG. 7 is a top view of a support structure.

Referring now to FIG. 7, an end-on view of support structure 22 in the form of a broadhead tip 36 is provided. The point 38 represents the joining of, for example only, four flat surfaces 40. Each flat surface 40 includes an exit for through holes 28 and 30. The through holes 28 and 30 "connect" oppositely positioned flat surfaces 40 as illustrated. That is to say, through holes 28-28 create one set of through holes 28 and through holes 30-30 create another set of through holes 30. Also illustrated are capture grooves 42. There are four capture grooves 42 illustrated but any number of capture grooves 42 desired can be accommodated.

Figure 8:
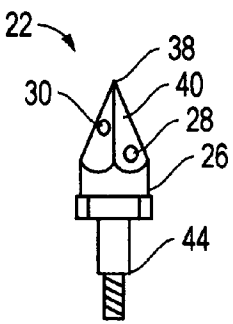
FIG. 8 is a side view of the support structure of FIG. 7.

Referring now to FIG. 8, a side view of support structure 22 in the form of broadhead tip 16 is illustrated along with the elements disclosed and discussed with regard to FIG. 7. Additionally, connection shaft 44 is illustrated. Connection shaft 44 is any connection device now known or hereafter developed for connecting broadhead tip 16 to an additional support structure (not shown) such as, for example only, an arrow shaft (not shown) as is known in the art.

Figure 9:
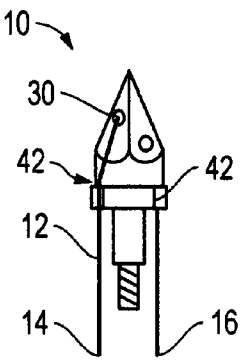
FIG. 9 is a side view of the wire broadhead apparatus according to the embodiment shown in FIG. 6 as attached to a support structure.

Referring now to FIG. 9, flexible wire 12 is shown attached to broadhead tip 16. One of the major advantages of the present invention is the ease by which flexible wire 12 is connected to broadhead tip 16, for example only. According to this aspect of the invention, all that is necessary is to pass first end 14 of flexible wire 12 through exit hole 30. Flexible wire 12 is moved through the through hole 30 until rotation spacer/straight section 20 is encompassed within through hole 30. Thereafter, the length of wire 12 including end 14 of flexible wire 12 is placed within capture groove 42, as illustrated. On the opposite side the length of wire 12 including end 16 is also placed within capture groove 42. As presented, FIG. 9 illustrates the "in-flight" position of flexible wire 12 according to this embodiment. As can be seen, this "in-flight" position is an extraordinarily streamlined position wherein the length of wires 14 and 16 are held in place in capture grooves 42 so as to run parallel to connection shaft 44, for example only.

Figure 10:
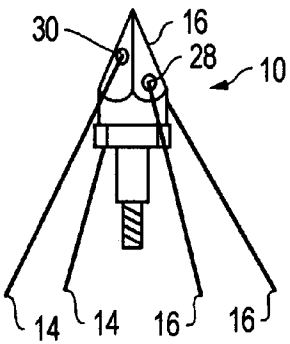
FIG. 10 is a side view of the invention of FIG. 9 with the wire ends released from the support structure.

FIG. 10 shows a second section of flexible wire 12 connected to broadhead tip 16 in the same manner. It should be appreciated by reference to this figure in particular that the cutting area created by the very narrow flexible wire 12 is very large. Heretofore, this wide cutting area was only possible by means of connection to a broadhead arrow, for example, of a flat section of a blade. The prior art blades, as discussed above, were attached to the support structure such that once they were in their extended position they were designed not to move. That is to say, the prior art devices included none of the movement allowed and encouraged by Applicants invention as discussed and illustrated hereafter with regard to FIG. 11, for example.

Figure 11:
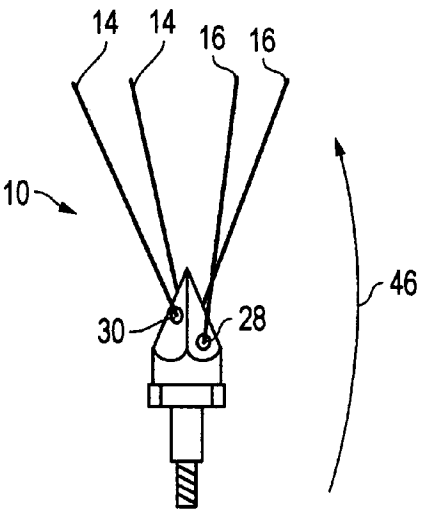
FIG. 11 is a side view of the invention of FIGS. 9 and 10 showing that the wires are free to rotate within the support structure in the direction of the arrow as when the apparatus is removed from the target animal.

FIG. 11 illustrates the unique ability of Applicant's wire broadhead apparatus 10, according to this embodiment, to allow all of the sharpened flexible wires 12 to rotate within broadhead tip 16 in the direction of direction arrow 46. As previously described with regard to FIG. 5, flexible wire 12 includes at least one razor-sharp edge 34. Preferably flexible wire 12 includes multiple razor-sharp edges 34 such that, when support structure 22 including broadhead tip 16 is removed in the direction opposite of direction arrow of 46, flexible wires 12 rotate on rotation spacer/straight section 20 into the position illustrated in FIG. 11. As can be seen, the pair of flexible wires 12 still maintain their spaced apart relationship between ends 14 and ends 16. Thus, because flexible wire 12 includes sharpened edges 34, even as broadhead tip 16 is removed, cutting is accomplished by the flexible wire 12 razor-sharp edges 34. This unique feature, among others, of Applicant's invention in any embodiment disclosed herein separates it from all other broadheads now known or previously developed.

Referring now to FIGS. 12 A-C, another embodiment of the invention is disclosed wherein the wire broadhead apparatus 10 is enclosed within a sabot 48. Sabot 48 is shown In FIG. 12 A encompassing support structure 22 and wires 12. According to this embodiment, sabot 48 can be utilized when support structure 22 is a projectile 23 to be fired from a gun. In that instance, sabot 48 is discarded once the projectile 23 leaves the gun barrel thereafter exposing flexible wire 12 as illustrated in FIG. 12 B. FIG. 12 C shows that once free of sabot 48 wires 12 are free to rotate around to the trailing position shown in FIG. 12 C prior to hitting a target. Thus, it should be appreciated, that all the advantages of the wire broadhead apparatus 10 discussed above with regard to flexible wire 12 wherein the free ends 14 and 16 are not attached to the support structure 22 are accomplished in this embodiment as well.

According to the embodiment of the invention as shown in FIGS. 12 A-C, killing is not intended to be done with the force of impact as with a normal projectile/bullet. Instead, killing is accomplished as with the other embodiments set forth herein where the projectile 23 with the extended wire 12 slices a neat hole thru the vital organs and the animal dies with minimal suffering.

It should be appreciated by reference to the figures that the cutting area created by the very narrow flexible wire 12 in each of the embodiments discussed and illustrated is very large. Heretofore, this wide cutting area was only possible by means of connection to a broadhead arrow, for example, of a flat section of a blade. The prior art blades were attached to the support structure such that once they were in their extended position they were designed not to move. Because flexible wire 12 includes sharpened edges 34, even as the support structure 22 is removed from an animal or target, cutting is accomplished by the flexible wire 12 razor-sharp edges 34. This unique feature, among others, of Applicants invention separates it from all other broadheads now known or previously developed By way of further explanation, prior to impact, flexible wires 12 are in their extended, full diameter shape as shown in FIGS. 3, 10 and 12 C, for example. In any event, as illustrated, it can be appreciated that when wire(s) 12 contact something of substance, such as an animal's rib bones, ends 14 and 16 slide within grooves 32 or are free to compress together and in either case the diameter of wire 12 (see e.g. wire 13 of FIG. 4) is greatly reduced and breakage of the wire 12 is prevented. Then, once flexible wire 12 has passed through the obstruction such as the rib bones, it is free to expand to its normal spaced apart relationship as shown in FIGS. 3 10 and 12 C. This expansion of diameter is the result of the shaped wire 12 assuming its original position on the support structure by the ends 14 and 16 sliding within grooves 32 or returning freely to the memory set space as shown in FIGS. 6, 10 and 12 C for example.

Currently all other fixed bladed or mechanical broadheads attempt to force their way past hard bones due to being fixed and immovable at that point in their transiting the targeted chest cavity. All prior art concepts whether fixed or mechanical in design account for portions of solving the many issues related to the problems known by those with knowledge of the art of archery and broadhead design. It is Applicant's invention, however, that provides flight from bow to target animal as accurate as a target tip (Applicant's tests resulted in consistently accurate and successful hits on the target at vastly increased distances); that penetrates easily the chest cavity by maintaining flexible razor sharpened wire 12 to cut on contact not relying on any mechanical, flat razor blade pivoting point or pinned camming motion or movement such as prior art; that includes shape memory expansion due to the stored kinetic energy in compression of the razor sharpened memory wire 12 until exposed within the soft tissue vital organs to maximize cutting length and widths in sizes equal to or significantly larger and longer than any previous prior art broadheads. Further, Applicant's invention surpasses any prior art due to engineering the maximum opportunity to efficiently exit the targeted game animal chest cavity via the ability of the razor sharp wire 12 to compress its cutting width thereby allowing passing of the hard bone surfaces and exiting the skin of the game animal, for example, on the opposite side of entry. This maximizes the amount of air that can escape and supports rapid deflation of damaged lungs. Greater amounts of body fluids are released from the larger cuts and this enhances the opportunity of creating a blood trail and subsequent easy tracking and recovery of the game animal.

Further that there are no mechanical means, pins or mechanical parts required to hold razor sharpened wire or wires 12 in place. It is the shape of the razor sharpened wire 12, including stop controls 18 and straight section 20 that holds the wire 12 to support structure 22. According to one embodiment shown in FIG. 14, the memory set shape provides stored energy of a spring and two contact points of the ends 14 and 16 of the wire 12 pushing into the grooves 32 of support structure 22 that provides the means to prevent the wire 12 once pushed into place in through holes 28 and 30 to hold it in place on support structure 22. This aspect of the invention, in each embodiment disclosed herein, minimizes the number of parts required to complete assembly of a finished broadhead thus providing for mechanical simplicity and maximum durability with zero opportunity to fail under maximum impact load energy conditions.

Further, use of a razor sharpened wire 12 allows equal to or significantly longer lethal cutting surfaces with a minimum of added weight to the overall finished broadhead. Weight is a critical factor in that more cutting length and or surface is provided by Applicant's invention thereby enhancing the lethal nature of the cutting within the soft tissue vital organs of the targeted game animal, for example only, for the same given weight of any prior art broadheads whether fixed bladed or mechanical.

Further, another advantage of Applicant's invention is provided by the memory shaped razor sharpened wire 12. The suitable wire is very flexible in nature and has a minimal cross sectional area combined with the free floating lateral pivoting movement allowed in normal operation of the broadhead in flight as well as in impact and transition thru the targeted game animal. The razor sharpened wire 12 cannot be broken and fail even under the most adverse hunting conditions; the wire 12 always provides exposed cutting surfaces 34 to the object the projectile strikes. All other prior art broadheads are mechanically weaker and will fail via shearing of blades, rolling over the edge of blades or, due to the length of the body design, they simply snap or bend under extreme duress impact loads.

It, again, can be appreciated that any wire capable of conforming to the requirements of the invention is suitable such as the material called "Nitinol" or more commonly "Spring Steel Wire". The razor sharpened wire 12 is easily field replaceable with no tools should it become dull thru normal use and is, therefore, very cost effective and extreme field use friendly in comparison to current market standards.

The description of the present embodiments of the invention have been presented for purposes of illustration but are not intended to be exhaustive or to limit the invention to the form or materials disclosed. Many modifications and variations will be apparent to those of ordinary skill in the art. As such, while the present invention has been disclosed in connection with the preferred embodiment thereof, it should be understood that there may be other embodiments which fall within the spirit and scope of the invention as described herein and as defined by the following claims.

What is claimed is:

1. A wire broadhead apparatus comprising:

a) a support structure; and b) a flexible wire with a first end and a second end wherein the flexible wire is connected to the support structure between the ends and wherein the ends are movingly engaged with the support structure and wherein the support structure includes grooves within which the first and second ends slide.

2. The apparatus of claim 1 wherein the support structure is an arrow head.

3. The apparatus of claim 1 further comprising more than one flexible wire connected to said support structure.

4. The apparatus of claim 1 wherein the flexible wire includes a straight section and stop controls.

5. The apparatus of claim 1 wherein the flexible wire includes end bends near the first and second ends.

6. The apparatus of claim 1 wherein the flexible wire is memory shaped spring steel razor wire.

7. The apparatus of claim 1 wherein the flexible wire includes more than one sharp edge.

8. The apparatus of claim 1 wherein the support structure includes at least one through hole through which the flexible wire is partially passed and connected to said support structure.

* * * * *